US007820904B1

(12) United States Patent
Robling et al.

(10) Patent No.: US 7,820,904 B1
(45) Date of Patent: Oct. 26, 2010

(54) PHANTOM POWERED PEDALS

(76) Inventors: Jason O. Robling, 561 Primus Ct., Frederick, MD (US) 21703; Michael B. Milbert, 15221 Arminio Ct., Darnestown, MD (US) 20874

( * ) Notice: Subject to any disclaimer, the term of this patent is extended or adjusted under 35 U.S.C. 154(b) by 232 days.

(21) Appl. No.: 12/221,745

(22) Filed: Aug. 6, 2008

Related U.S. Application Data

(60) Provisional application No. 60/963,530, filed on Aug. 6, 2007.

(51) Int. Cl.
*G10H 3/00* (2006.01)

(52) U.S. Cl. ..... 84/746; 84/600; 84/626; 84/662

(58) Field of Classification Search ..... 84/626, 84/630, 631, 662, 664, 600–602, 746
See application file for complete search history.

(56) References Cited

U.S. PATENT DOCUMENTS

| | | | | |
|---|---|---|---|---|
| 4,445,415 | A * | 5/1984 | Izquierdo | 84/177 |
| 4,737,735 | A | 4/1988 | Kampes | |
| 5,105,711 | A * | 4/1992 | Barnard | 84/744 |
| 5,166,467 | A * | 11/1992 | Brown | 84/715 |
| 5,459,283 | A * | 10/1995 | Birdwell, Jr. | 84/737 |
| 5,866,829 | A * | 2/1999 | Pecoraro | 84/177 |
| 6,215,055 | B1 * | 4/2001 | Saravis | 84/422.1 |
| 6,538,185 | B1 * | 3/2003 | Stratton | 84/422.1 |
| 6,545,204 | B1 * | 4/2003 | Wadell | 84/422.1 |
| 6,723,909 | B1 * | 4/2004 | Hooper, II | 84/453 |
| 6,800,810 | B1 | 10/2004 | Page | |
| 7,608,776 | B2 * | 10/2009 | Ludwig | 84/721 |
| 7,709,726 | B2 * | 5/2010 | Smith | 84/626 |
| 2003/0066410 | A1 * | 4/2003 | Stratton | 84/422.1 |
| 2003/0172797 | A1 * | 9/2003 | Juszkiewicz et al. | 84/601 |
| 2004/0182230 | A1 * | 9/2004 | Vlant et al. | 84/662 |
| 2004/0208328 | A1 | 10/2004 | Strother | |
| 2004/0250673 | A1 * | 12/2004 | Salerno | 84/746 |
| 2005/0089175 | A1 * | 4/2005 | Van Tassel | 381/63 |
| 2006/0278068 | A1 * | 12/2006 | Nielsen et al. | 84/746 |
| 2008/0006140 | A1 * | 1/2008 | Adams | 84/455 |
| 2008/0282869 | A1 * | 11/2008 | Adams | 84/455 |
| 2009/0272016 | A1 * | 11/2009 | Grigsby | 40/299.01 |
| 2009/0282967 | A1 * | 11/2009 | Skillings | 84/742 |

* cited by examiner

*Primary Examiner*—David S. Warren
(74) *Attorney, Agent, or Firm*—James Creighton Wray

(57) ABSTRACT

Musical instrument effects pedals are powered from adjacent pedals by providing electrical connectors between adjacent pedals and by providing tip-ring-sleeve jacks in the pedals and three wire connectors with tip-ring-sleeve connectors, which carry sound signals from an instrument through sequential pedals and electrical power in an opposite direction to the pedals.

18 Claims, 8 Drawing Sheets

PHANTOM POWERED PEDALS

This application claims the benefit of U.S. Provisional Application No. 60/963,530, filed Aug. 6, 2007, which is hereby incorporated by reference in its entirety.

SUMMARY OF THE INVENTION

The invention provides and controls phantom power to a chain of pedals from a power supply and audio signal connecting box.

A tip-ring-sleeve connector cable provides power from the power supply box to a first pedal. Additional pedals may be connected by tip-ring-sleeve connector cables. A tip-sleeve connector cable connects the last distal pedal to a guitar. Audio signals from the guitar are carried to the last pedal by the tip-sleeve cable. Pedal-modified signals are carried to the power supply and audio signal connecting box through the tip-ring-sleeve cables. The box is connected to an amplifier by a tip-sleeve connector cable.

Microphones are currently phantom powered but use a different type of cable and different impedance than guitarists/instrument cables. Multiple microphones are not linked together. Effects pedals can be and frequently are linked together in-line. Each pedal provides a different effect on the audio signals.

Electric guitarists and bass players regularly use effects pedals that are placed on the floor in front of the musician and are engaged or disengaged by stepping on a switch that is part of the pedal. These effects alter the audio signal in various ways: echo, distortion, chorus, compression, etc. All of them require internal or external power. At present, these pedals are either powered by batteries (usually 9 volt), or use power adapters (usually the "wall-wart" type that plug into a standard AC wall outlet and then use a transformer to convert the voltage to DC, usually 9 volts). Both of these methods (batteries and adapters) are frustrating to the musician. Batteries can die during a performance and are expensive. Power adapters are cumbersome, messy, and pose a hazard on stages where performers or other people can trip over the extraneous wires.

A chain of phantom powered effects pedals solves these problems by supplying the necessary voltage through standard stereo style audio cables among the pedals in the chain and between the first pedal and the box. Currently, guitarists and bassists use ¼" mono connector cables. All that is necessary to send phantom power back to the pedals is a standard shielded ¼" tip-ring-sleeve connector/cable, which will work in the existing type of connector jacks.

The pedals have simple modifications: tip-ring-sleeve style jacks replace tip-sleeve jacks and/or additional dip switches to allow for various pedal set-up chains. Pedals can be chained together in-line, and the phantom power could power all of them. Additionally, with the proper circuit and switch configuration, DC voltage potentially could be sent to other non-phantom powered pedals by sending the DC voltage OUT through one or more existing DC voltage IN mini-jacks, which would not be in use if the pedal was using phantom power.

The power supply unit would be placed near the amplifier, away from the musicians' feet. This is where the audio cable going from the last pedal in the chain of pedals to the amplifier would "pick-up" the required DC voltage. Eventually and optimally, amplifier manufacturers could implement this power supply into the amplifiers themselves, and no external power supply would be needed. A small switch could be placed on the amplifier, either on the front or back, activating the 9 volt DC to send to the pedals. Similarly, this is the way almost all mixing consoles are now built (including the small switch) to power phantom powered microphones.

Additionally, since not all pedals will be able to receive phantom power, a small box, appearing much like an effect pedal, could be placed with the other pedals, last in the chain of pedals, i.e. last unit before signal goes to power supply/amplifier, to receive the phantom power, and then to distribute the required DC voltage to the other pedals through the existing/conventional adapter jacks.

The power supply unit could have an on/off switch, one or more extra AC receptacles, an LED light to show that there is power present, a fuse and one or more DC plug receptacles.

On the phantom power distributor pedal, there are many possible variations as well; for example, the distributor pedal could perform some other function, like the ability to mute the audio signal with the footswitch and to redirect the audio output to a tuner. Also, other various possibilities exist. An LED light on the pedal shows that power is present, which is good and practical, especially for trouble-shooting. The distributor pedal could also have any number of DC outlets of the small, currently existing kind, as well as a reverse-polarity DC outlet. Some older pedals have reverse polarity on their DC inputs. Reverse polarity switches reverse the positive and negative leads on the jacks. Any number of variations of these features could be employed. The distributor pedal would be totally passive, requiring no power itself.

Implementing the power supply in an amplifier so that no external power supply would be needed would not require that the power supply be contained in its own box. The amplifier itself would serve as the enclosure.

Switching in the phantom powered pedals could be accomplished by any electromechanical means, be it ganged or independent switches, and be of any variety; including toggle, DIP, rotary, push-button, slide, CMOS or similar, or relay or other electromechanical contact, directly or indirectly actuated mechanically or electrically or via software and/or remote control. Whether using separate jacks or switches—the same changes of DC power function are performed. One feature of the phantom powered effect pedal is the ability to send the DC power out through the existing DC-in jack, with the potential of placing additional DC in/out jacks so that a switch would not be needed.

These and further and other objects and features of the invention are apparent in the disclosure, which includes the above and ongoing written specification, with the drawings.

DETAILED DESCRIPTION OF THE PREFERRED EMBODIMENTS

The drawings are for the purpose of illustrating the invention's preferred embodiments and not for the purpose of limiting the invention.

Figure 1:
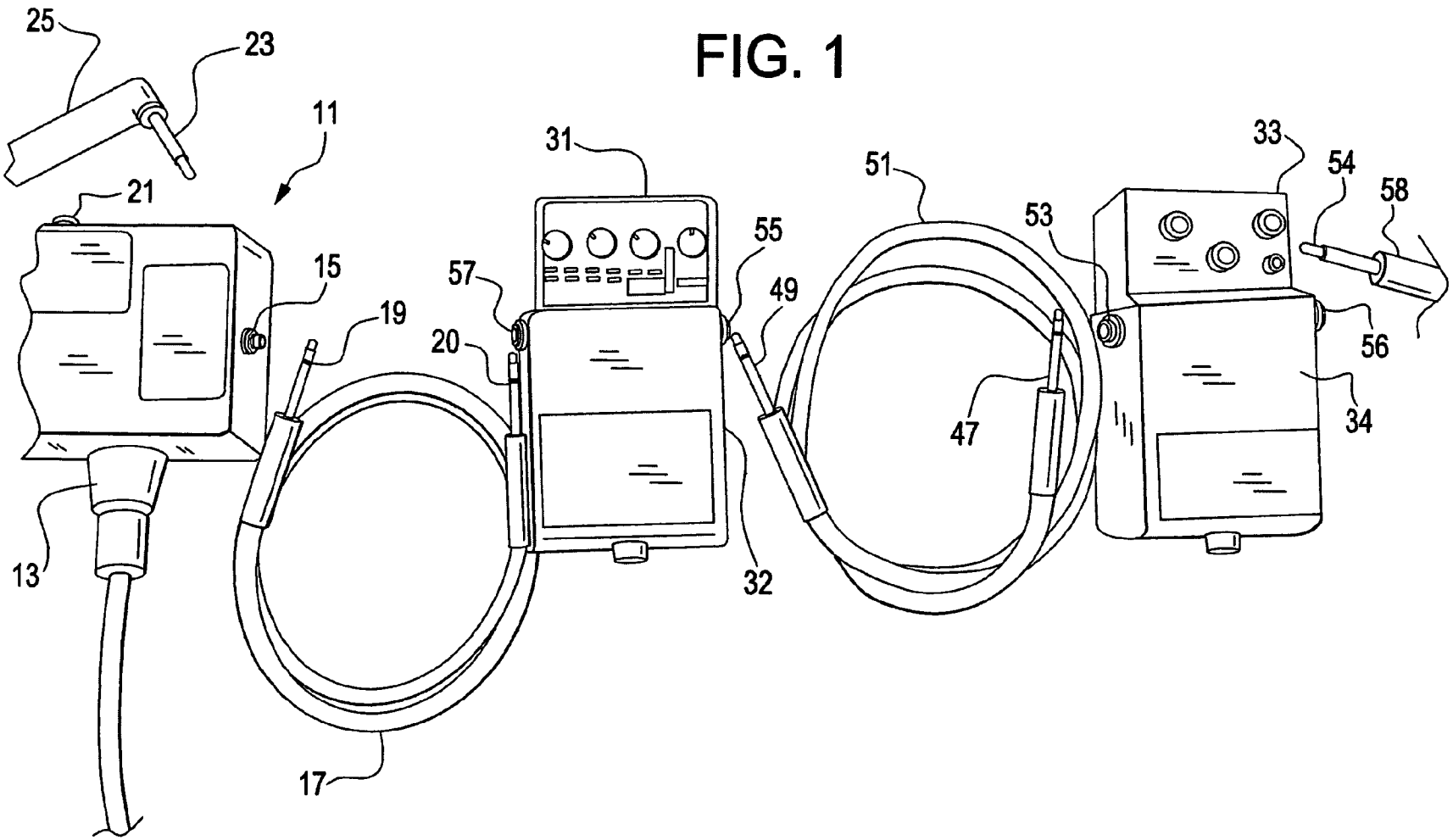
FIG. 1 is a view of the system showing a power supply, including an audio signal input, two phantom powered pedals and connectors.

FIG. 1 shows the DC power supply box 11, which includes an AC power input connector 13, a step-down transformer and an AC-DC converter within the box 11, a three-wire cable jack 15 for connecting a three-wire cable 17 for audio signal input to the box 11 and phantom power output from the box 11 and a two-wire audio signal output cable jack 21 for receiving a connector 23 on a two-wire audio signal output cable 25 to an amplifier. The three-wire cable 17 has a first end tip-ring-sleeve (TRS) connector 19 for connection to the three wire jack 15 and a second end tip-ring-sleeve connector 20 for connecting to effects pedal 31, to provide phantom power from box 11 to the effects pedal and to transfer audio signals from the effects pedal through the box 11 to the amplifier.

Effects pedal 33 is connected to the effects pedal 31 with tip-ring-sleeve end connectors 47 and 49 on a three-wire cable 51. Connector 47 connects to the audio signal output jack 53 of the effects pedal 33, and connector 49 connects to audio signal input jack 55 of the effects pedal 31. The audio signal output jack 57 on pedal 31 receives/secures the second end connector 20 of the three-wire cable 17. Phantom power from the power supply box 11 travels through the jacks, connectors, and three-wire cables 17 and 51 to provide power to the effects pedals 31 and 33. Pedal 33 has an audio input jack 56 which receives a tip-sleeve connector 54 on an audio cable 58 from a guitar. Hinged foot tread switch operators 32 and 34 on the pedals 31 and 33 are moved by foot to turn the pedals on and off.

Figure 2:
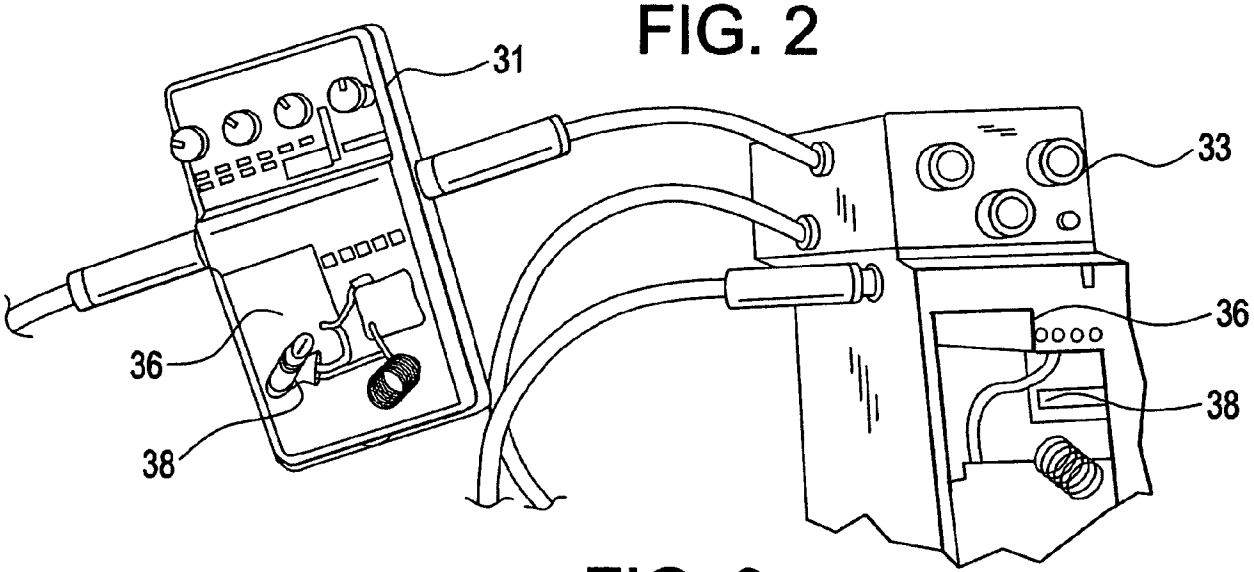
FIG. 2 is a view of the connectors and pedals with the foot switches removed to show the absence of batteries.

FIG. 2 shows effects pedals 31 and 33 with the hinged foot tread switch operators raised to show that 9 volt batteries have been removed from battery compartments 36 and battery connectors 38.

Figure 3:
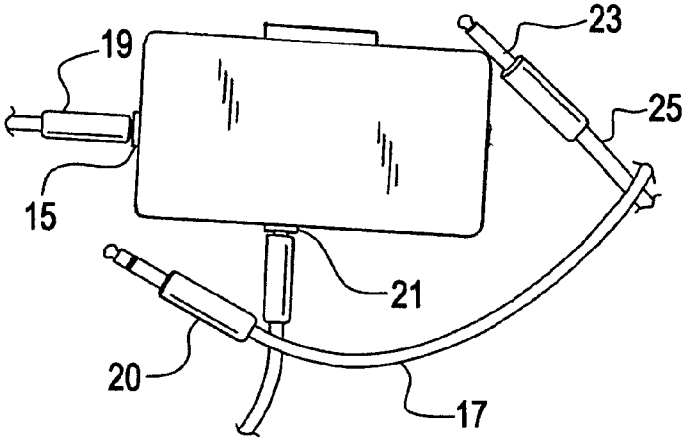
FIG. 3 is a detail of the phantom power supply and cable connections to an AC source, to the first pedal and to the amplifier.

FIG. 3 is a detail of the connections to the power supply showing the AC input, the jack 15, tip-ring-sleeve connectors 19 and 20 on cable 17 and jack 21 with tip-ring (TR) connector 23 on audio signal cable 25.

Figure 4:
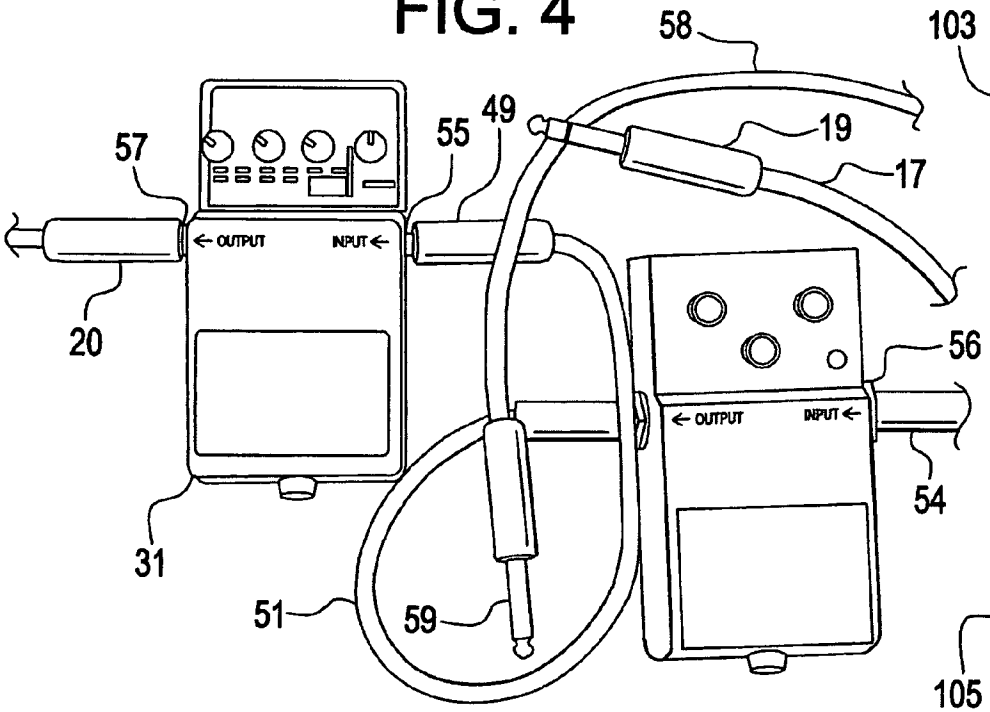
FIG. 4 is a detail of two in-line pedals with connecting cables.

FIG. 4 is a detail of the pedals and their connections as described with reference to FIG. 1, showing the tip-sleeve audio connector 59 from the cable 58 to the guitar.

Figure 5:
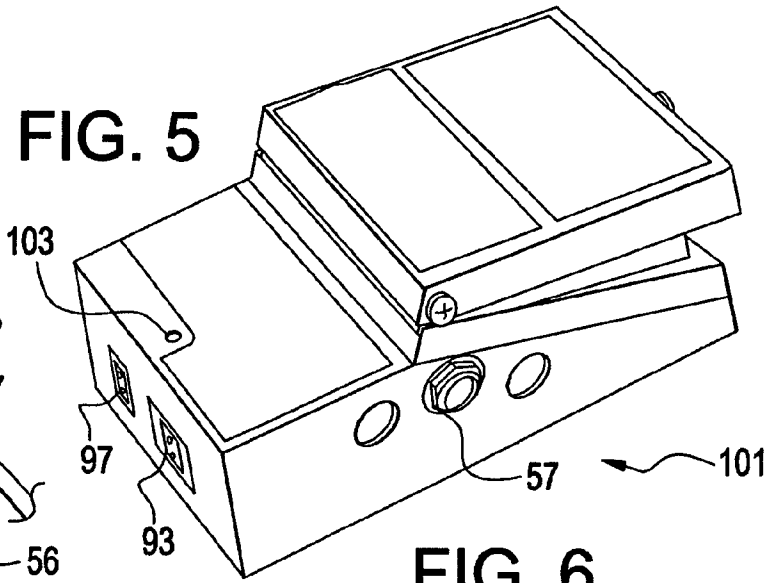
FIG. 5 is a detail of a distributor pedal with a phantom power input jack and two DC output receptacles.
Figure 6:
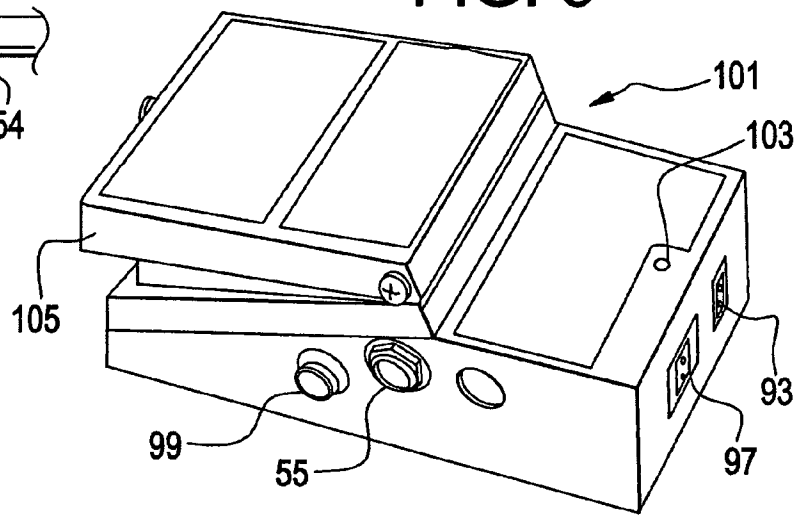
FIG. 6 is an opposite side detail of distributor pedal in FIG. 9.

FIGS. 5 and 6 show the phantom distributor pedal with one output jack 57 and two input jacks. The DC power outlets 93, 97 and audio input 99 are also shown. LED 103 emits a light when power is on.

Figure 7:
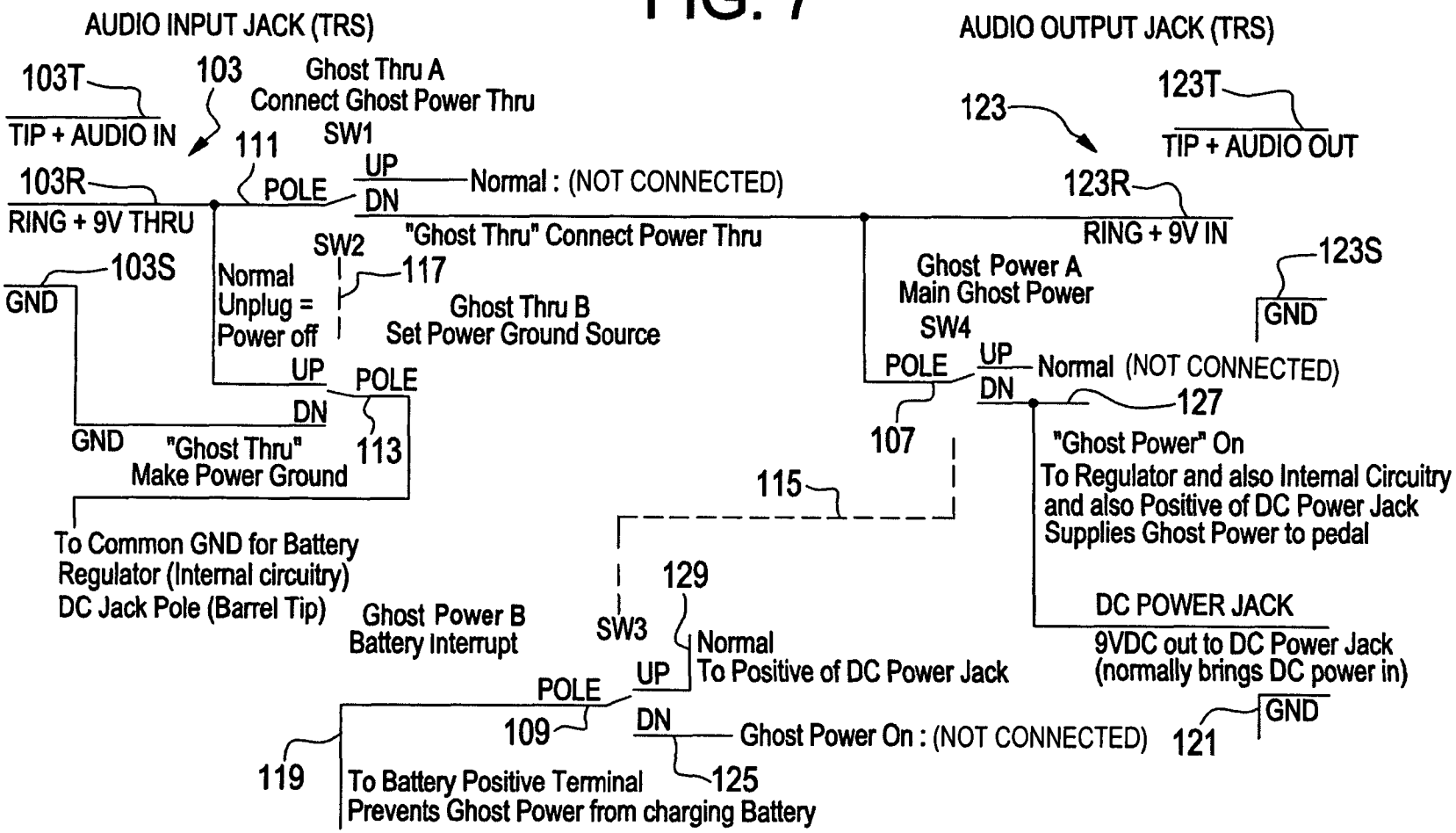
FIG. 7 is a schematic representation of the invention.

In FIG. 7, "On" is down ("ON") on all four switches 107, 109, 111 and 113. Long dash lines 115 and 117 show ganged switches. Deviation from stock: If Ghost Thru A and B 111, 113, 117 is left on with battery installed, then automatic "unplug=power-off" is defeated, as Ghost Thru B switch maintains battery circuit to ground GND. FIG. 7 shows the phantom powered effect pedal circuit including a three-conductor ¼" TRS (tip-ring-sleeve) jack 103 for audio input on the tip 103T and 9V DC power output on the ring 103R, and ground on the sleeve 103S. The tip 123T of ¼" TRS jack 123 has audio output; the ring 123R has 9V DC input, and the sleeve 123S is ground. The audio signal will always pass from the tip 103T of connector 103 to the tip 123T of connector 123. 9V DC will be present on the ring 103R of connector 103 only if both the ganged 115 Ghost Power A and B switches 107 and 109 are down (on), and Ghost Thru A and B switches 111 and 113 are down, allowing 9V DC to pass from the ring 123R of jack 123 to the ring 103R of jack 103. Switches 107 and 109 are ganged together 115 in a single DPDT (double pole, double throw) switch, shown by the dashed line 115, so that they switch simultaneously. The same is true for switches 111 and 113, ganged together 117, as shown by the dashed line 117. When all switches 107, 109, 111, and 113, are in the up (normal) position, the pedal functions in a completely "stock" (normal) mode, so that it can be powered by a battery at 119 through line 129, or with DC power from an AC adapter/transformer at the DC IN jack 121, a standard mini-barrel type. With all switches 107, 109, 111, and 113 in the up (normal) position, the battery will not be grounded (or discharged) at 113 and 107, as the ring 123R at TRS connector 123 will function as a ground if a TS (tip-sleeve) cable is plugged into the pedal at jack 123 when phantom power is not being used. When the "Ghost Power" switches 107, and 109 are in the down position (on), power is supplied to the pedal regulator at 127, and the battery is removed from the circuit at 125, to prevent charging the battery, and allowing the user to safely keep a battery in the pedal if desired. When switch 107 and 109 are in the down (on) position, 9V DC is also sent through switch 107 to the mini-barrel DC IN jack 121, which allows the pedal to send out 9V DC via a standard two-conductor jumper cable to power additional non-phantom powered pedals. This feature allows the use of phantom powered pedals and non-phantom powered pedals together in-line, without the need for batteries or power supplies for the non-phantom powered pedals.

Figure 8:
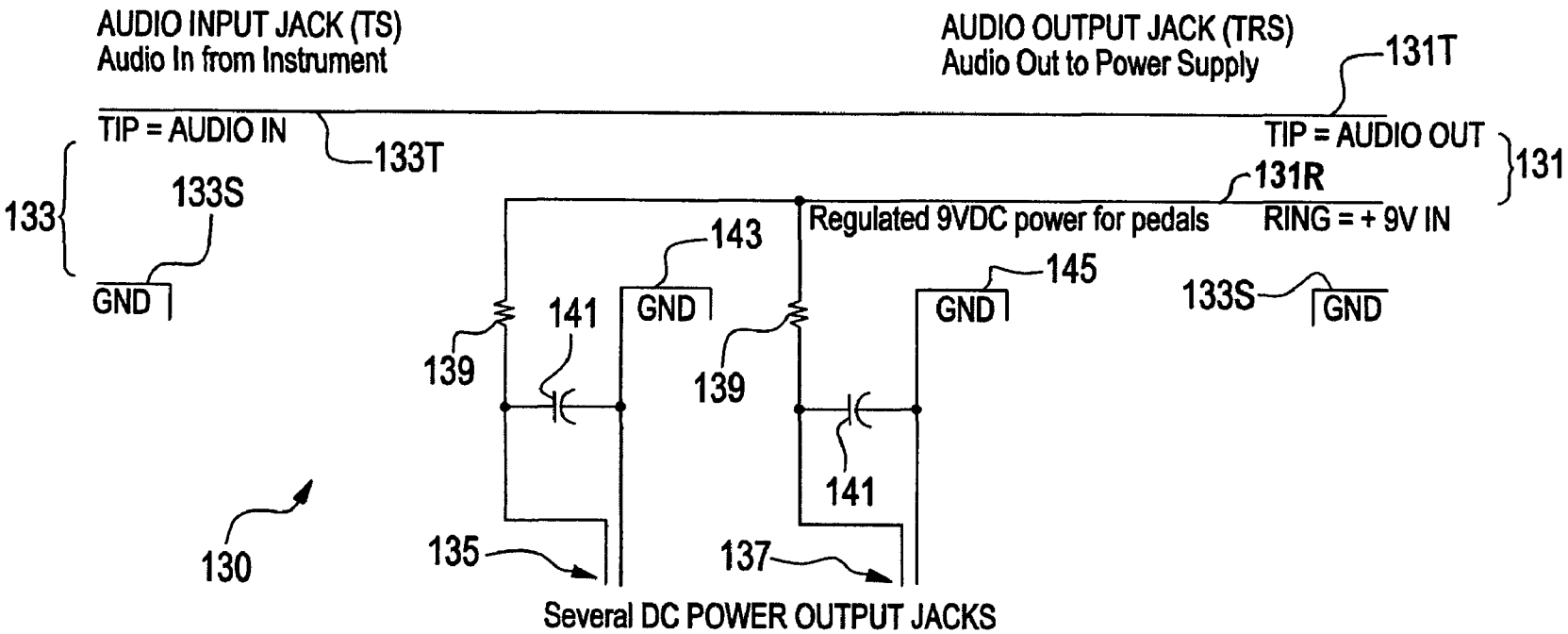
FIG. 8 is a schematic representation of the power distributor breakout box.

FIG. 8 is a detail of the phantom power distributor unit, first pedal box or breakout box 130 that is placed near the other effects pedals (non-phantom powered pedals). Jack 133 is a ¼" TS jack with audio-in signal on the tip 133T, which is sent directly to the audio-out tip 131T of jack 131. The sleeve 133S of jack 133 and the sleeve 131S of jack 131 are both ground, as well as points 143 and 145 on the DC power output jacks. The ring 131R of jack 131 supplies 9V DC to the identical DC-outs 135 and 137, which are standard two-conductor mini-barrel type, or standard mini-phone plug (⅛"), most commonly used in musical effects pedals. Several identical DC output jacks may be added to allow for ease of powering more pedals. A resistor 139 and capacitor 141 are added to each DC output 135, 137 to help isolate the power to each pedal.

Figure 9:
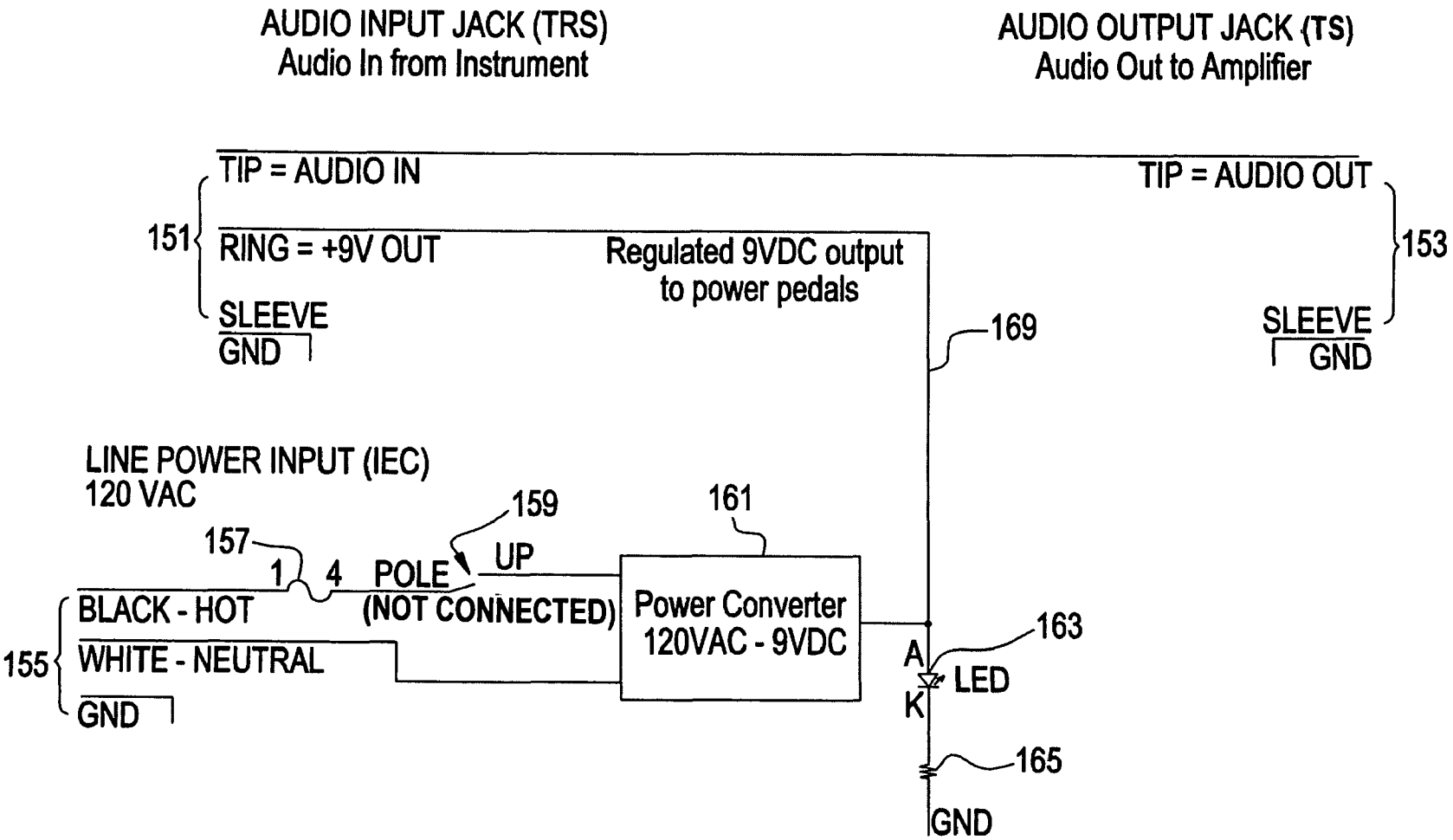
FIG. 9 is a schematic representation of the power supply.

FIG. 9 is a detail of the power supply unit which supplies regulated 9V DC to the ring of a standard ¼" TRS jack 151, to be sent out to phantom powered musical effects pedals or the breakout box. 120 VAC is supplied at connector 155, and supplies power via the black (hot) wire to the power converter 161, but first passes through a fuse 157 and a main switch 159. The white-neutral wire from connector 155 is connected directly to the power converter 161. The power converter 161 supplies regulated 9V DC via wire 169 to ring of ¼" TRS jack 151. The tip of jack 151 is audio-in and is wired directly to the audio-out tip of the ¼" TS jack 153. The sleeve of jack 151 and the sleeve of jack 153 are both ground. An LED 163 and resistor 165 are added as a visual indicator that the power supply box is active.

Figure 10:
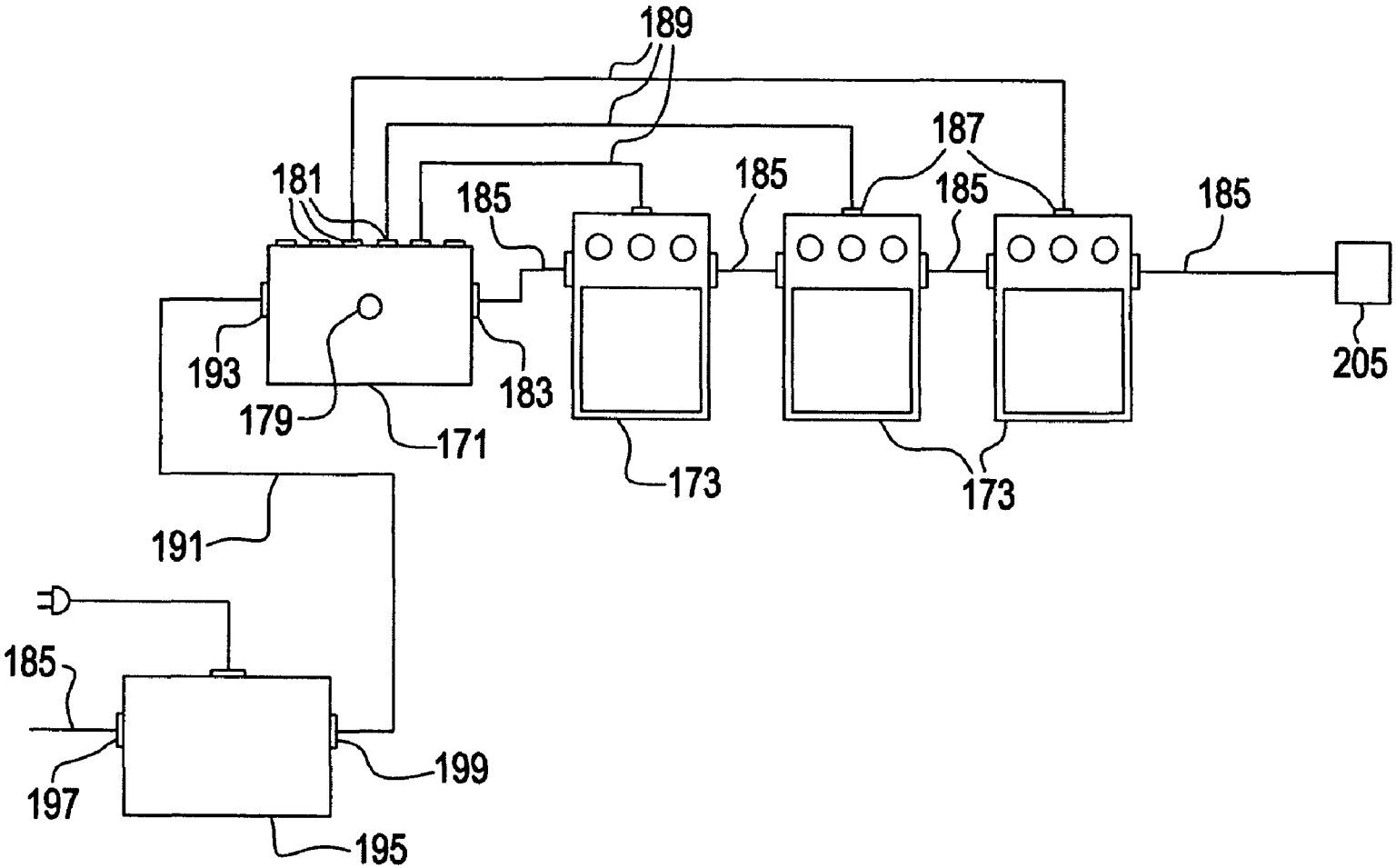
FIG. 10 is a schematic representation of the series of pedals.

FIG. 10 shows the system of using the breakout box 171 to power non-phantom powered effects pedals 173, thereby eliminating the need for new or modified pedals, batteries, extension cords, or individual power supplies to power individual pedals. The ring of a ¼" TRS cable 191 carries 9V DC to the breakout box 171 from the power supply 195. An LED 179 shows that the breakout box is active and supplying power to the DC outputs 181. The power supply 195 may also be enclosed and/or implemented inside the instrument amplifier. 199 and 193 are ¼" TRS jacks. 9V DC is supplied from the ring at jack 193 and sent to the standard two-conductor mini DC outs 181, which can then be sent to standard mini DC-in connectors 187 at multiple non-phantom powered effects pedals 173 via standard two-conductor jumper cables 189. Audio from the instrument 205 is passed through the effects pedals on the tip of a standard TS cable 185, and further TS cables 185 are used to connect all pedals 173 together and to supply the audio signal to the breakout box at jack 183. The audio is sent from the tip of jack 183 to the tip of jack 193, and is then sent to the amplifier through the tips of jacks 199 and 197 and TS Cable 185.

Figure 11:
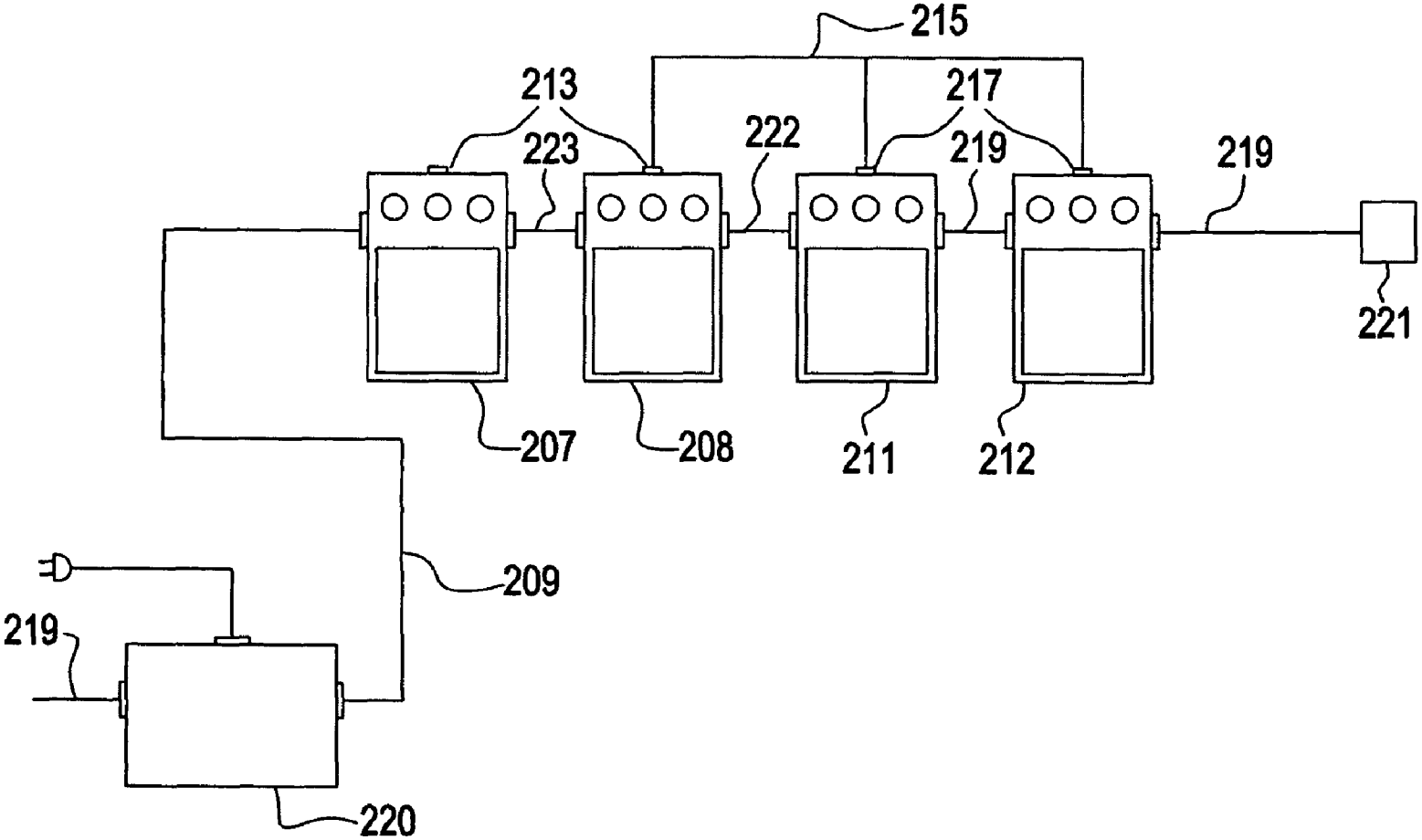
FIG. 11 is a schematic representation of the series of pedals.

FIG. 11 shows the system of powering phantom powered effects pedals 207, 208 and non-phantom powered effects pedals 211 and 212 without the use of batteries, extension cords, or adapters for all pedals, both phantom powered, and non-phantom powered. The ring of a ¼" TRS cable 209 and 223 carries 9V DC to the phantom powered effects pedals 207, 208 from the power supply 220. The power supply 220 may also be enclosed and implemented inside the instrument amplifier. The phantom-thru switch is engaged (on) at pedal 207, allowing power to pass through pedal 207 to also power pedal 208, via the TRS cable 223. The phantom-thru switch is not engaged (off) in pedal 208, because the next pedal 211 will not receive phantom power via a TRS cable. When phantom power is turned on in pedal 207 and 208, 9V DC is sent out from the mini DC power jack 213 (normally used as a DC-in jack when phantom power is turned off), powering the non phantom powered pedals 211 and via mini two-conductor jumper cables 215 connected from jack 213 to jacks 217. Audio is passed from the musical instrument 221 to the amplifier through the pedals 212, 211, 208, 207 and power supply unit 220 via the tips of the ¼" TS cables 219 and 222 and TRS cables 223 and 209.

While the invention has been described with reference to specific embodiments, modifications and variations of the invention may be constructed without departing from the scope of the invention.

The invention claimed is:

1. Music pedal apparatus comprising:

plural pedals, comprising a first pedal, a last pedal and intermediate pedals between the first pedal and the last pedal, serial connections between the plural pedals connecting the plural pedals sequentially from the first pedal through intermediate pedals to the last pedal, a combined amplifier and power supply box having an amplifier and a power supply, a first connector connected to the first pedal, an instrument connector connected to the last pedal wherein the instrument connector is provided for carrying audio signals from an instrument to the last pedal, wherein the serial connections are provided for carrying audio signals from the last pedal sequentially through the intermediate pedals to the first pedal, wherein the first connector is provided for simultaneously carrying audio signals from the first pedal to the amplifier in the amplifier and power supply box, wherein the first connector is adapted for simultaneously carrying low voltage direct current power from the power supply in the amplifier and power supply box to the first pedal, wherein the serial connections are adapted for carrying the low voltage direct current power from the first pedal sequentially to the intermediate pedals and through the intermediate pedals to the last pedal.

2. The apparatus of claim 1, wherein the pedals have audio signal inputs and audio signal outputs.

3. The apparatus of claim 2, wherein the pedals further comprising audio signal altering circuits within the pedals and audio signal input connections between the audio signal inputs and the audio signal altering circuits and audio signal output connections between the audio signal outputs and the audio signal altering circuits.

4. The apparatus of claim 3, the pedals further comprising audio signal directing switches in the pedals for selectively connecting the audio signal inputs with the audio signal outputs and connecting the audio signal inputs and audio signal outputs with the signal altering circuits in the pedals.

5. The apparatus of claim 1, further comprising direct current power switches in each pedal for selectively connecting and disconnecting the low voltage direct current power to the audio signal altering circuits.

6. The apparatus of claim 1 wherein each pedal further comprises a power input and a power line extending from the power input, an audio signal input and an audio signal output, an audio signal altering circuit having a circuit input and a circuit output, an audio signal switch for selectively connecting the audio signal input to the audio signal output or connecting the audio signal input to the circuit input and connecting the circuit output to the audio circuit outlet, and a power switch connected to the power line for selectively connecting or disconnecting the power line from the audio signal altering circuit.

7. The apparatus of claim 6, wherein each of the first pedal and the intermediate pedals have power outlets connected to the power line.

8. An electronic audio altering system comprising a power supply with an AC line voltage input and a relatively low DC voltage output, an amplifier with a low power audio input and a higher power audio output, a first pedal box, a first power input mounted in the first pedal box and connected to the low voltage DC output of the power supply and to the low power audio input of the amplifier, multiple low voltage DC outlets mounted in the first pedal box and connected to the first power input, interconnected and an audio signal input, and an audio signal output interconnected and mounted in the first pedal box, a last pedal box, an audio signal input and audio signal output mounted in the last pedal box, at least one intermediate pedal box, at least one audio signal modifying circuit mounted in the at least one intermediate pedal box, an audio signal output and an audio signal input mounted in the at least one intermediate pedal box, at least one audio signal switch mounted in the at least one intermediate pedal box and connected to the audio signal input, the audio signal output and connected to the audio signal modifying circuit for selectively connecting the audio signal input to the audio signal output and selectively connecting the audio signal modifying circuit between the audio signal input and the audio signal output in the at least one intermediate pedal box.

9. The system of claim 8, further comprising a low voltage DC power input and output connected to the at least one intermediate pedal box.

10. The system of claim 9, further comprising a power switch connected to the power input, to the power output and to the audio signal modifying circuit in the at least one intermediate pedal box for selectively providing power to the modifying circuit in the at least one intermediate pedal box.

11. The system of claim 10, wherein the power input of the at least one intermediate pedal box is connected to one of the multiple low voltage DC outputs of the first pedal box.

12. A method of providing power to special audio effects pedals comprising providing a power supply, connecting the power supply to an AC power line, connecting a first end of a three-wire connector to the power supply, connecting a second end of the three-wire connector to a first box, supplying power from the power supply to the first box via the three-wire connector, connecting plural pedals to the first box with wires, supplying power from the first box to the plural pedals through the wires, connecting an instrument audio output to one of the pedals, connecting the audio output from said one of the pedals through the plural pedals to the first box, connecting the audio output from the first box through wires in the three-wire connector to the power supply and from the power supply to an audio connector in an audio amplifier.

13. The method of claim 12, wherein the first box is a power distribution box having plural power outputs, and the connecting the plural pedals comprises connecting first ends of plural power connectors to the first box and connecting second ends of the plural power connectors to power inputs of the pedals.

14. The method of claim 12, wherein the first box is a power distribution box having plural power outputs and the connecting the plural pedals comprises connecting first ends of three-wire connectors between the box and a first pedal and sequentially from the first pedal to a further pedal.

15. The method of claim 14, further comprising connecting first ends of power connectors to the first pedal and connecting second ends of the power connectors to other pedals.

16. The method of claim 15, further comprising connecting a normal power input connection of the first pedal to power inputs of the other pedals.

17. The method of claim 12, where the first box is a first pedal having plural power outputs.

18. The method of claim 17, further comprising connecting power wires from the other pedals to the plural power outputs of the first pedal.

* * * * *